US011012803B2

(12) United States Patent
Bernard et al.

(10) Patent No.: US 11,012,803 B2
(45) Date of Patent: May 18, 2021

(54) PROCESSING METHOD AND SYSTEM FOR PANNING AUDIO OBJECTS

(71) Applicant: AURO TECHNOLOGIES NV, Mol (BE)

(72) Inventors: Benjamin Bernard, Chalon-sur-Saone (FR); Francois Becker, Chalon-sur-Saone (FR)

(73) Assignee: AURO TECHNOLOGIES NV, Mol (BE)

( * ) Notice: Subject to any disclaimer, the term of this patent is extended or adjusted under 35 U.S.C. 154(b) by 0 days.

(21) Appl. No.: 16/481,205

(22) PCT Filed: Jan. 29, 2018

(86) PCT No.: PCT/EP2018/052160
§ 371 (c)(1),
(2) Date: Jul. 26, 2019

(87) PCT Pub. No.: WO2018/138353
PCT Pub. Date: Aug. 2, 2018

(65) Prior Publication Data

US 2019/0373394 A1 Dec. 5, 2019

(30) Foreign Application Priority Data

Jan. 27, 2017 (EP) ..... 17153650

(51) Int. Cl.
*H04S 7/00* (2006.01)
*H04R 5/04* (2006.01)
(Continued)

(52) U.S. Cl.
CPC ..... *H04S 7/303* (2013.01); *H04R 3/12* (2013.01); *H04R 5/02* (2013.01); *H04R 5/04* (2013.01);
(Continued)

(58) Field of Classification Search
CPC .. H04S 7/303; H04S 2400/11; H04S 2400/13; H04R 3/12; H04R 5/02; H04R 5/04
(Continued)

(56) References Cited

U.S. PATENT DOCUMENTS 2,298,618 A 10/1942 Garity et al.
2016/0212559 A1 7/2016 Mateos Sole et al.

FOREIGN PATENT DOCUMENTS

GB 394325 6/1933
WO 2011117399 A1 9/2011
(Continued)

OTHER PUBLICATIONS

Ramy Sadek et al., "A Novel Multichannel Panning Method for Standard and Arbitrary Loudspeaker Configurations", Convention Paper 6263, AES 117th Convention, Oct. 1, 2004, pp. 1-5.
(Continued)

*Primary Examiner* — Vivian C Chin
*Assistant Examiner* — Douglas J Suthers
(74) *Attorney, Agent, or Firm* — Sughrue Mion, PLLC

(57) ABSTRACT

The current invention related to methods and systems for panning audio objects on multichannel loudspeaker setups. The invention relates to a method of processing an audio object along an axis, said audio object comprising an audio object abscissa and an audio object spread, for spatialized restitution thereof over a plurality of sound transducers, N in number, aligned along said axis; each of said sound transducers comprising a transducer abscissa; N being at least equal to two; said method comprising a plurality of steps.

4 Claims, 7 Drawing Sheets

(51) Int. Cl.
*H04R 5/02* (2006.01)
*H04R 3/12* (2006.01)

(52) U.S. Cl.
CPC ..... *H04S 2400/11* (2013.01); *H04S 2400/13* (2013.01)

(58) Field of Classification Search
USPC ..... 381/303; 700/94
See application file for complete search history.

(56) References Cited

FOREIGN PATENT DOCUMENTS

| | | | |
|---|---|---|---|
| WO | 2013143934 | A1 | 10/2013 |
| WO | 2014001478 | A1 | 1/2014 |
| WO | 2014159272 | A1 | 10/2014 |
| WO | 2014160576 | A2 | 10/2014 |
| WO | 2015017235 | A1 | 2/2015 |

OTHER PUBLICATIONS

Ville Pulkki, "Uniform spreading of amplitude panned virtual sources", Proceedings of the 1999 IEEE Workshop on Applications of Signal Processing to Audio and Acoustics, Oct. 1, 1999, pp. 187-190.
Written Opinion for PCT/EP2018/052160, dated Mar. 27, 2018.
International Search Report for PCT/EP2018/052160, dated Mar. 27, 2018.

PROCESSING METHOD AND SYSTEM FOR PANNING AUDIO OBJECTS

PCT/EP2018/052160 filed Jan. 29, 2018, claiming priority based on European Patent Application No. 17153650.1 filed Jan. 27, 2017, the entire disclosures of which are incorporated by reference herein.

TECHNICAL FIELD

The present invention relates to a sound processing method and system for panning audio objects on multichannel speaker setups.

BACKGROUND

Sound panning systems are typical components of the audio production and reproduction chains. They have been commonly found in cinema mixing stages for decades, more recently in movie theaters and home movie theaters, and allow spatializing audio content using a number of loudspeakers.

Modern systems typically take one or more audio input streams comprising audio data and time-dependent positional metadata, and dynamically distribute said audio streams to a number of loudspeakers which spatial arrangement is arbitrary.

The time-dependent positional metadata typically comprises three dimensional (3D) coordinates, such as Cartesian or spherical coordinates. The loudspeaker spatial arrangement is typically described using similar 3D coordinates.

Ideally, said panning systems account for the spatial location of the loudspeakers and the spatial location of the audio program, and dynamically adapt the output loudspeakers gains, so that the perceived location of the panned streams is that of the input metadata.

Typical panning system compute a set of N loudspeaker gains given the positional metadata, and apply said N gains to the input audio stream.

Numerous panning systems technologies have been developed for use in research or theatrical facilities.

Stereophonic systems have been known since Blumlein works, especially in GB 394325, followed by the system used for the Fantasia movie as described in U.S. Pat. No. 2,298,618, along with other movie-related systems such as WarnerPhonic. The standardization of stereophonic vinyl discs allowed a large democratization of stereophonic audio systems.

An adaptation of content-creation systems, especially mixing desks, was then mandatory as they were only capable of monophonic sound mixing. Switches were added to consoles to direct sounds to one channel, or the two simultaneously. Such a discrete panning system was widely used until the mid-1960s, when double-potentiometer systems were introduced in order to allow a continuous variation of the stereophonic panning without degrading the original signal.

Based on the same repartition principle, the so-called surround panning systems were thereafter introduced to allow the distribution of a monophonic signal on more than two channels, for instance in the context of movie soundtracks where the use of three to seven channels is common. The most frequently encountered implementation, commonly called "pair-wise panning", consists of a double stereophonic panning system, one being used for left-right distribution, and the other for front-back distribution. Extending such a system to three dimensions, by adding a third panning system to manage up-down sound repartition between horizontal layers of transducers, is then trivial.

However, in some cases, one has to position a transducer between left-right or front-back positions, for example a center channel placed in the middle of the left and right channels and used for dialogue in movie soundtracks. This mandates substantial modifications of the stereophonic panning system. Indeed, for esthetical or technical reasons, it can be desirable to either playback a centered signal via the left and right channels, or via the center channel alone, or even via the three channels at the same time.

The emergence of object-based audio formats such as Dolby Atmos or Auro-Max recently required additional transducers in intermediate positions to be added, for instance along the walls of a movie theatre, in order to assure a good localization precision of said audio objects. Such systems are commonly managed by the so-called pair-wise panning systems mentioned above, in which transducers are used by pair. The use of such pair-wise panning systems can be justified, among other reasons, by the symmetry of the transducer set in the room. Coordinates used in such systems are typically Cartesian ones, and assume that transducers are positioned along the faces of a room surrounding the audience.

Other approaches were disclosed, such as Vector-Based Amplitude Panning (VBAP), an algorithm that allows computing gains for transducers positioned on the vertices of a triangular 3D mesh. Further developments allow VBAP to be used on arrangements that comprise quadrangular faces (WO2013181272A2), or arbitrary n-gons (WO2014160576).

VBAP was originally developed to produce point-sources panning on arbitrary arrangements. In "Uniform spreading of amplitude panned virtual sources" (Proc. 1999 IEEE Workshop on Applications of Signal Processing to Audio and Acoustics, New Paltz, N.Y., Oct. 17-20, 1999), Pulkki presented a new addition to VBAP, multiple-direction amplitude panning (MDAP) to allow for uniform spread of sources. The method basically involves additional sources around the original source position, which are then panned using VBAP and superimposed to the original panning gains. If non-uniform spreading is needed, or more generally on dense speaker arrangements in the three-dimensional panning case, the number of additional sources can be very high and the computational overhead will be substantial. MDAP is the method used in MPEG-H VBAP renderer.

Similarly, in the context of three-dimensional panning methods, WO2014159272 (Rendering of audio objects with apparent size to arbitrary loudspeaker layouts) introduces a source width technique based on the creation of multiple virtual sources around the initial source, the contribution of which are ultimately summed to form transducer gains.

In "An optimization approach to control sound source spread with multichannel amplitude panning" (Proc. CSV24, London, 23-27 Jul. 2017), Franck et al. proposed another method for source width control, based on a convex optimization technique, this method reduces itself to VBAP in the absence of source width. Some virtual-source methods also involve a decorrelation step, such as WO2015017235.

Ambisonics, which are based on a spherical harmonics representation of a soundfield, have also been extensively used for audio panning (a recent example being given in WO2014001478).

The most important drawback in original Ambisonics panning techniques is that the loudspeaker arrangement shall be as regular as possible in the 3D space, mandating the use of regular layouts such as loudspeakers positioned at the vertices of platonic solids, or other maximally regular tessellations of the 3D sphere. Such constraints often limit the use of Ambisonic panning to special cases. To overcome these limitations, mixed approaches using, for example, both VBAP and Ambisonics have been disclosed in WO2011117399 and further refined in WO2013143934.

Another issue with Ambisonics is that point-sources are almost never played back by one or two speakers only: because the technology is based on a reconstruction of the soundfield at a given position or in a given space, for a single point-source a large number of speakers will emit signals, possibly phase shifted. While it theoretically allows for a perfect reconstruction of the soundfield in a specific location, this behaviour also means that off-centred listening positions will be somewhat suboptimal in this regard: the precedence effect will, in some conditions, make point-source perceived as coming from unexpected positions in space.

Other approaches have also been presented that are able to use totally arbitrary spatial layouts, for example Distance-Based Audio Panning (DBAP) ("Distance-based Amplitude Panning", Lossius et al., ICMC 2009). In "Evaluation of distance based amplitude panning for spatial audio", DBAP was shown to yield satisfactory results compared to third-order Ambisonics, especially when the listener is off-centred in regard to the speaker arrangement, and was also shown to perform very similarly to VBAP in most configurations.

The most prominent issue with DBAP is the choice of the distance-based attenuation law, which is central to the algorithm. As shown in US20160212559 a constant law can only handle regular arrangements, and DBAP has problems with irregular spatial speaker arrangements, due to the fact that the algorithm doesn't take the spatial speaker density into account.

Also presented was Speaker Placement Correction Amplitude Panning (SPCAP) ("A novel multichannel panning method for standard and arbitrary loudspeaker configurations", Kyriakakis et al., AES 2004). Both the DBAP and SPCAP methods only account for the metric between the intended position of the input source and the positions of the loudspeakers, for instance the Euclidean distance in the DBAP case, or the angle between the source and the speakers in the SPCAP case.

One of SPCAP advantages over the above discrete panning schemes is that it was originally developed to provide a framework for producing wide (non-point-source) sounds.

To this effect, a virtual three-dimensional cardioid, whose principal axis is the direction of the panned sound, is projected onto the spatial loudspeaker arrangement, the value of the cardioid function indirectly yielding the final loudspeakers gains. The tightness of said cardioid function can be controlled by raising the whole function to a given power greater or equal to 0, so that sounds with user-settable width can be produced.

The cardioid law proposed in Kyriakakis et al., AES 2004, is a power-raised law:

$$r = \frac{1}{2^d}(1+\cos(\theta))^d,\ d \in [0, 1]$$

where d denotes the spread-related width, which is indicative of the spatial extent of the source with respect to the position of the source, and ranges from 0 to 1.

SUMMARY OF THE INVENTION

One key observation with prior art methods such as SPCAP is that the cardioid law as proposed in Kyriakakis et al., AES 2004 is not adequate to produce point-sources: one cannot simulate such focused sources without running into speaker attraction issues.

Another issue with the proposed power-raised law in the original SPCAP algorithm is the discontinuity of said cardioid function at an angle of r: for $u \neq 0$, $r(\pi)=0$, but for $u=0$, $r(\pi)=1$. This means that a speaker positioned at the exact opposite of the panned source would never produce any sound for values of u close but not equal to 0, but would abruptly produce sound for u=0.

To illustrate the inadequacy of the cardioid law, FIGS. 4 and 5 show the effect of the tightness control (or, equivalently, spread control) for the original SPCAP algorithm. On the FIG. 4, with a narrow directivity, the sound jumps from speaker to speaker, as can be seen on the grey curves that show Makita's "velocity" and Gerzon's "energy" vector directions. The velocity vector can be computed as $$\vec{r_u} = \frac{\sum_{i=1}^{N} \vec{l_i} g_i}{\sum_{i=1}^{N} g_i}$$

and is considered to be a good indicator of how sound localization is perceived under 700 to 1000 Hz, whereas the energy vector, computed as $$\vec{r_e} = \frac{\sum_{i=1}^{N} \vec{l_i} g_i^2}{\sum_{i=1}^{N} g_i^2},$$

gives sound localization above 700 to 1000 Hz. In the above, $\vec{l}_i$ is the unitary vector pointed towards the i-th transducer, and $g_i$ is the gain of the i-th transducer. On FIG. 5, with a wide directivity, one can see sound "spilling" on adjacent speakers, as expected. Therefore, the original SPCAP algorithm cannot provide a satisfactory way to produce moving point-sources.

It is an object of the present invention to provide solutions to the issues of all aforementioned standard algorithms, namely:

- the complexity of VBAP's source spreading approaches,
- the lack of capabilities of SPCAP to produce satisfactory fixed or moving point-sources,
- the fact that Ambisonic's point-sources are typically emitted by a large number of speakers, hence producing a suboptimal soundfield in off-centred listening positions,
- and the issues of DBAP with irregular arrangements, such as the ones found in movie theaters.

In a first aspect, the invention provides a method of processing an audio object along an audio axis according to claim 1.

The disclosed invention builds upon a substantially modified version of the original SPCAP, solves the issues mentioned above, while keeping the advantages of the algorithm.

In the disclosed invention, the cardioid law is modified so that it bears no spatial discontinuity when the spread changes, and the spread is no longer constrained to the 0 . . . 1 interval.

In one embodiment, the cardioid law is modified to a pseudo-cardioid law, $$r = \frac{1}{\left(2+\frac{1}{u}\right)^u}\left(1+\frac{1}{u}+\cos(\theta)\right)^u,\ u \in [0, \infty]$$

where u denotes the spread according to the present invention, which ranges from 0 to infinity. Any other law having the same spatial continuity with variable values of spread can be used instead. An example according to the present invention is presented in FIG. 6.

To solve the moving point-source issues presented in FIGS. 4 and 5, the present algorithm also adds a virtual speaker at the same position as the source. It then uses the following steps:

1. The gains for the loudspeakers that surround the source are computed, by means of any applicable panning law, for example via amplitude or distance-based panning.
2. An additional, virtual speaker is also added to the speaker arrangement. Said virtual speaker has the same position as the panned source.
3. the SPCAP algorithm is run using the modified cardioid law and the physical loudspeaker arrangement with the addition of said virtual speaker, yielding loudspeaker gains for the modified speaker arrangement.
4. the virtual loudspeaker signal is redistributed over said surrounding speakers, using the gains found in the first step, optionally modified by the tightness value.

This novel algorithm solves the abovementioned issues:

- contrary to SPCAP, point-sources can be produced by the disclosed method, as, in this case, the tightness is high and the speaker gains exactly follow those found with the standard panning law used during the first step (for example amplitude or distance-based).
- contrary to Ambisonics, point-sources are emitted by a limited number of loudspeakers, even possibly a single speaker in some conditions.
- contrary to VBAP, maximally wide sounds can be produced by means of the simple, spatially-continuous law disclosed above, and all intermediate source width values can be produced by the algorithm, with no extra step.
- contrary to DBAP, the fact that a modified SPCAP algorithm is used ensures that speaker density can be taken into account by the panning algorithm.

This algorithm also ensures that even for high values of spread, the acoustic energy and velocity vectors of the panned source are still closely aligned to the intended source position.

As such, novel technical aspects of the invention when compared to the original SPCAP algorithm may relate to the following

- usage of an additional, virtual speaker,
- keeping both energy and velocity vectors aligned to the intended source position even with spread sources,
- prevent channel spilling on adjacent loudspeakers for focused sources,
- ensuring continuity with a modified spread law, allowing maximally spread sources to really have a 360° spread.

In a second aspect, the present invention provides a method of processing an audio object with respect to an inner surface of a parallelepipedic room, according to claim 3.

In a third aspect, the present invention provides a method for processing an audio object with respect to an inner surface of a sphere according to claim 4.

According to further aspects, the present invention provides a system for processing an audio object along an axis according to claims 4-5, a system for processing an audio object with respect to an inner surface of a parallelepipedic room, according to claim 6, and a system for processing an audio object with respect to an inner surface of a sphere according to claim 7.

According to further aspects, the invention offers a use of the method according to claims 1-2 in the system according to claims 5-6, a use of the method according to claim 3 in the system according to claim 7, and a use of the method according to claim 4 in the system according to claim 8.

Preferred embodiments and their advantages are provided in the detailed description and the dependent claims.

DETAILED DESCRIPTION OF THE INVENTION

Figure 1:
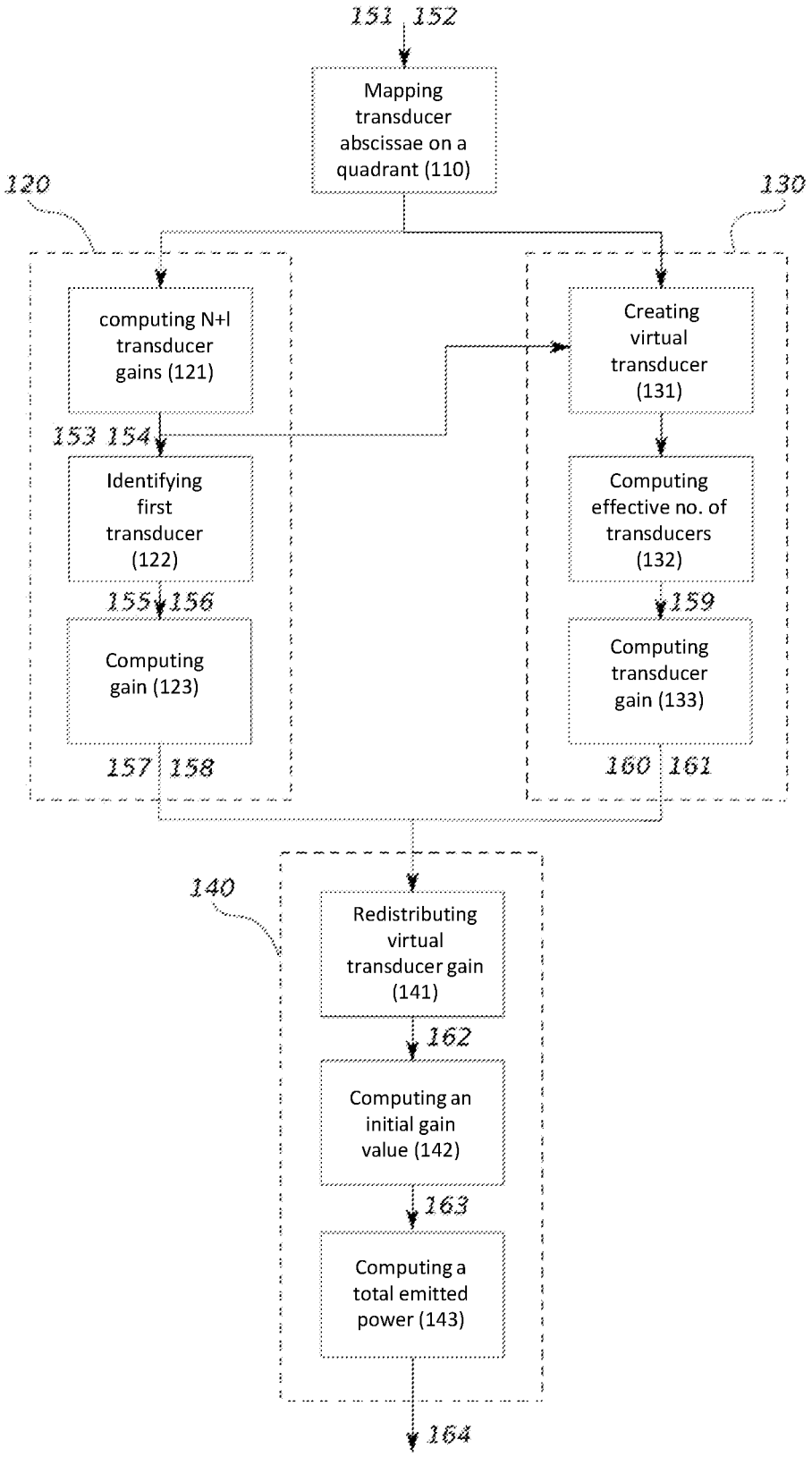
FIG. 1 illustrates a first example embodiment of the method according to the present invention.

The invention relates to a processing method and system for panning audio objects.

In this document, the terms "loudspeaker" and "transducer" are used interchangeably. Furthermore, the terms "spread", "directivity" and "tightness" may be used interchangeably in some instances but not necessarily in all instances, and all relate to the spatial extent of the audio object with respect to the position of the audio object, and ranges from 0 to 1.

In this document, the term "source" refers to an audio object taking the role of source.

In a preferred embodiment, for notational convenience, the spread-related width d is replaced by the spread u according to the present invention, which is indicative of the spatial extent of the source with respect to the position of the source and ranges from 0 to infinity, and may relate to the spread-related width d according to following formulas: $u=d/(1-d)$; and, conversely, $d=u/(1+u)$. The spread u is e.g. used throughout the claims. In other embodiments, the present invention is illustrated by using the equivalent spread-related width d, as for instance in the case of FIG. 7. As is clear to the skilled person, both u and d merely refer to different notations of the same quantity, and hence any statement including any formula using one of the two also discloses the complementary statement where the other one of the two is used.

The invention offers a plurality of related embodiments, and may be categorized in three groups of embodiments:

A group of one-dimensional embodiments, addressing audio panning on transducers positioned along a single axis. This may relate to the method according to claims 1-2 and the system according to claims 5-6. In one embodiment, the output of said group of embodiments may be applied immediately on physical speakers. In another embodiment, the invention may be part of a larger processing context, such as the calculation of a binaural rendering, whereby the output may be the input to a new processing step.

A group of triple-1D embodiments, best suited at audio panning on transducers positioned on the interior surfaces of a somewhat parallelepipedic room. This may relate to the method according to claim 3 and the system according to claim 7. In one embodiment, the output of said group of embodiments may be applied immediately on physical speakers. In another embodiment, the invention may be part of a larger processing context, such as the calculation of a binaural rendering, whereby the output may be the input to a new processing step.

A group of spherical 3D embodiments, addressing spherical transducer sets. This may relate to the method according to claim 4 and the system according to claim 8. In one embodiment, the output of said group of embodiments may be applied immediately on physical speakers. In a preferred embodiment, the invention is part of a larger processing context, such as the calculation of a binaural rendering, whereby the output may be the input to a new processing step.

In a first aspect, the invention provides a method of processing an audio object along an audio axis according to claim 1. This relates to a usage for panning on speakers positioned on a single wall, along an axis. In a preferred embodiment, this relates to following algorithm:

construct a virtual circle segment out of the abscissae, so that minimal and maximal abscissae values span a quadrant ($\pi/2$ aperture)

(1) find the two enclosing speakers $\alpha$ and $\beta$ by using object and speakers virtual azimuths on said quadrant (2) compute the two enclosing speakers gains $Q_\alpha$ and $Q_\beta$ using any stereo panning law (for ex. "tangent" panning law, or "sin-cos panning law" or any other law).

(3) virtually create a new loudspeaker on said quadrant, positioned at the object position. The layer now comprises N+1 speakers (N physical speakers and one virtual speaker)

(4) compute the SPCAP gains for the N speakers in said quadrant, using the modified LSPCAP method:

(a) compute the N+1 (N real speakers, 1 virtual) original gains using the following law $$P_i(\theta_{is}) = \frac{1}{\left(2+\frac{1}{u}\right)^u}\left(1+\frac{1}{u}+\cos(\theta_{is})\right)^u,$$

$$u \in [0, \infty],\ i \in [1 \ldots N+1]$$

wherein $\theta_{is}$ is the angle between the source and the speaker (b) redistribute the computed gain for the virtual (N+1)-th speaker by using the stereo gains $Q_\alpha$ and $Q_\beta$ computed above in step (2)

$$P_i = \sqrt{P_i^2 + \sqrt{\frac{u}{1+u}} \cdot Q_i^2}\text{, where } i=\alpha \text{ or } i=\beta$$

(c) compute the "initial gain values" $G_i$ by dividing the original gains by the precomputed effective number of speakers $$G_i(\theta_s) = \frac{P_i(\theta_{is})}{\beta_i},\ i \in [1 \ldots N]$$

(d) ensure power conservation by computing the total emitted power $$P_e(\theta) = \sum_{i=1}^{N} (G_i(\theta))^2$$

and by dividing the initial gains to yield the corrected gains for each speaker:

$$A_i = \frac{G_i}{\sqrt{P_e}},\ i \in [1 \ldots N]$$

In a second aspect, the present invention provides a method of processing an audio object with respect to an inner surface of a parallelepipedic room, according to claim 3. This relates to a "triple 1D processing", and relates to a usage with panning on speakers positioned on room's walls (front back left right top walls) where independent three-axis spread values are needed Preferred inputs are:

object coordinates, Cartesian object three-dimensional spread values along the x, y and z axis (range 0 to +infinity)

speaker arrangement:

Cartesian coordinates for each speaker, are normalized (left-right and front-back dimensions range from −1 to 1, as for bottom-top Z=0 for ear-level, Z=1 for ceiling)

In a preferred embodiment, the algorithm relates to the following:

Global algorithm:

(optional: apply speaker snap)

run 1D algorithm along the Z-axis, using only loudspeakers' Z abscissae and the Z spread value: obtain Z-gains for all loudspeakers determine unique Z coordinates list for the speaker arrangement, effectively constructing Z layers for each Z layer, run the 1D algorithm along the Y-axis, using only the layer's loudspeakers' Y abscissae and the Y spread value: obtain Y-gains for all loudspeakers for each Z layer, determine unique Y coordinates list, effectively constructing Y rows for each Z layer, and for each Y row, run the 1D algorithm along the X-axis, using only the row's loudspeakers' X abscissae and the X spread value: obtain X-gains for all loudspeakers multiply X-, Y- and Z-gains element-wise and apply 2-norm normalization to get final loudspeaker gains In a third aspect, the present invention provides a method for processing an audio object with respect to an inner surface of a sphere according to claim 4. This relates to a usage for panning on speakers positioned on a sphere Preferred inputs are:

object coordinates, spherical object spread value u (range 0 to +infinity)

speaker arrangement:

Spherical coordinates for each speaker spherical triangular mesh where speakers are positioned at the vertices.

In a preferred embodiment, the algorithm relates to the following:

Offline part:

Precompute the effective number of speakers for the speaker arrangement: compute the so-called "effective number of speakers" $\beta_1$ for only the N real loudspeakers:

$$\beta_i = \frac{1}{\left(2+\frac{1}{u}\right)^u}\left(1+\frac{1}{u}+\cos(\theta_i-\theta_j)\right)^u,\ u \in [0, \infty],\ i \in [1 \ldots N]$$

That value allows taking the speaker spatial density into account, by putting less weight (ie. less gain) on speakers that are close to each other. The number is computed for each speaker, using the whole set of speakers (including the one considered in the computation). One can note that $\beta_i$ is at least equal to 1. This value can be further modified by an affine function between 1 and its original value, to gradually account (or not) for the speaker density, if needed.

Real-time part, for given object coordinates:

(B): compute VBAP gains for each facet in the mesh and find enclosing facet for which all speaker gains are positive. Keep only the three gains for that facet, discard the rest (see Pulkki, 2001 for the detailed VBAP method)

(C): virtually create a new loudspeaker in the speaker arrangement, positioned at the object position. The arrangement now comprises N+1 speakers (N physical speakers and one virtual speaker)

(D) compute the SPCAP gains for the N speakers using the modified LSPCAP method:

(1) compute the N+1 (N real speakers, 1 virtual) original gains using the following law $$P_i(\theta_{is}) = \frac{1}{\left(2+\frac{1}{u}\right)^u}\left(1+\frac{1}{u}+\cos(\theta_{is})\right)^u,$$

$$u \in [0, \infty],\ i \in [1 \ldots N+1]$$

wherein $\theta_{is}$ is the angle between the source and the speaker (2) redistribute the computed gain for the virtual (N+1)-th speaker by using the three VBAP gains $Q_i$ computed above in step (A)

$$P_i = \sqrt{P_i^2 + \sqrt{\frac{u}{1+u}} \cdot Q_i^2},$$

i such that speaker i belongs to the active VBAP facet (4) compute the "initial gain values" $G_i$ by dividing the original gains by the effective number of speakers $$G_i(\theta_s) = \frac{P_i(\theta_{is})}{\beta_i},\ i \in [1 \ldots N]$$

(5) ensure power conservation by computing the total emitted power $$P_e(\theta) = \sum_{i=1}^{N} (G_i(\theta))^2$$

and by dividing the initial gains to yield the corrected gains for each speaker:

$$A_i = \frac{G_i}{\sqrt{P_e}},\ i \in [1 \ldots N]$$

In a further aspect, the present invention relates to following considerations.

Typical panning system compute a set of N loudspeaker gains given the positional metadata, and apply said N gains to the input audio stream.

For instance, Vector-Based Amplitude Panning allows computing said gains for loudspeaker positioned on the vertices of a triangular 3D mesh. Further developments allow VBAP to be used on arrangements that comprise quadrangular faces (WO2013181272A2), or arbitrary n-gons (WO2014160576).

Ambisonics have also been extensively used for audio panning (WO2014001478). The most important drawback in Ambisonics panning is that the loudspeaker arrangement must be as regular as possible in the 3D space, mandating the use of regular layouts such as loudpseakers positioned at the vertices of platonic solids, or other maximally regular tessellations of the 3D sphere. Said constraints limit the use of Ambisonic panning to special cases.

To overcome these problems, mixed approaches using both VBAP and Ambisonics have been disclosed in WO2011117399A1 and further refined in WO2013143934.

Other approaches have also been presented that are able to use totally arbitrary spatial layouts, for example Distance-Based Audio Panning (DBAP) ("Distance-based Amplitude Panning", Lossius et al., ICMC 2009) or Speaker Placement Correction Amplitude Panning (SPCAP) ("A novel multichannel panning method for standard and arbitrary loudspeaker configurations", Kyriakakis et al., AES 2004). Those methods only account for the distance between the intended position of the input source and the positions of the loudspeakers, for instance the Euclidean distance in the DBAP case, or the angle between the source and the speakers in the SPCAP case.

In "Evaluation of distance based amplitude panning for spatial audio", DBAP was shown to yield satisfactory results compared to third-order Ambisonics, especially when the listener is off-centred in regard to the speaker arrangement, and was also shown to perform very similarly to VBAP in most configurations.

Hereby, an important drawback with these distance-based methods is the lack of control over the spatial spread of the input source.

The invention is further described by the following non-limiting examples which further illustrate the invention, and are not intended to, nor should they be interpreted to, limit the scope of the invention.

EXAMPLES

Example 1: First Example Embodiment of the Method According to the Present Invention FIG. 1 illustrates an example embodiment of a method of the present invention, whereby the transducers, N in number, and the audio object are all present essentially on a single axis. The position of the N transducers (or, equivalently, loudspeakers), is expressed by their abscissae along said single axis. The position of the audio object may also be expressed as an abscissa. Furthermore, the audio object comprises a spread $u_i$ a value in [0, +∞[.

Particularly, FIG. 1 show the method as implemented in an embodiment of the present invention, ensuring panning of a source over N loudspeakers along an axis, the abscissae of the source (151) and of the loudspeakers (152) being known, where are shown the steps of (110) mapping the N abscissae to a quadrant, (111) determining the two closest loudspeakers (113, 114), (112) computing two stereo panning gains (115, 116) for said closest speakers using a stereo panning law, (120) adding a virtual transducer at the position of the source, (121) computing N+1 transducer gains (103) using one method disclosed in the present invention, (130) redistributing the N+1th gain of the virtual transducer to the two closest loudspeakers (113, 114) using the stereo panning gains (115, 116) yielding N gains (104), and (131) power normalizing said N gains (104) to yield final panning gains (105).

Example 2: Second Example Embodiment of the Method According to the Present Invention FIG. 2 illustrates an example embodiment of a method of the present invention, whereby the transducers, N in number, are positioned on a essentially parallelepipedic room.

Figure 2:
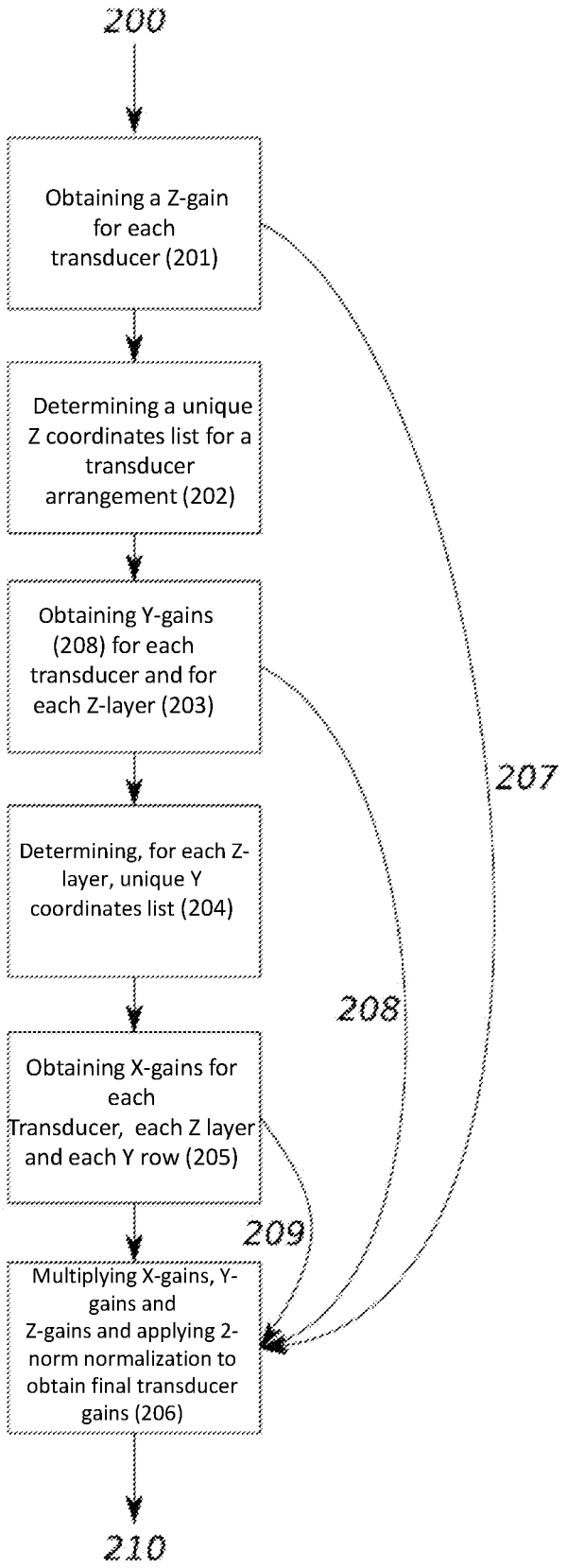
FIG. 2 illustrates a second example embodiment of the method according to the present invention.

Particularly, FIG. 2 shows the method as implemented in an embodiment of the present invention, with loudspeakers positioned on the walls with given Cartesian coordinates (200), where are shown the steps of (201) computing Z-gains (207) along the Z axis, (202) constructing Z layers, (203) computing Y-gains (208) along the Y axis for each Z layer, (204) constructing Y rows for each Z layer, (205) computing X-gains (209) along the X axis for each Y row, and (206) multiplying Z-gains, (207) Y-gains (208) and X-gains (209) element-wise and power normalizing the result to yield final loudspeaker gains (210).

Example 3: Third Example Embodiment of the Method According to the Present Invention FIG. 3 illustrates an example embodiment of a method of the present invention, whereby the transducers, N in number, are positioned on the inner surface of a sphere.

Figure 3:
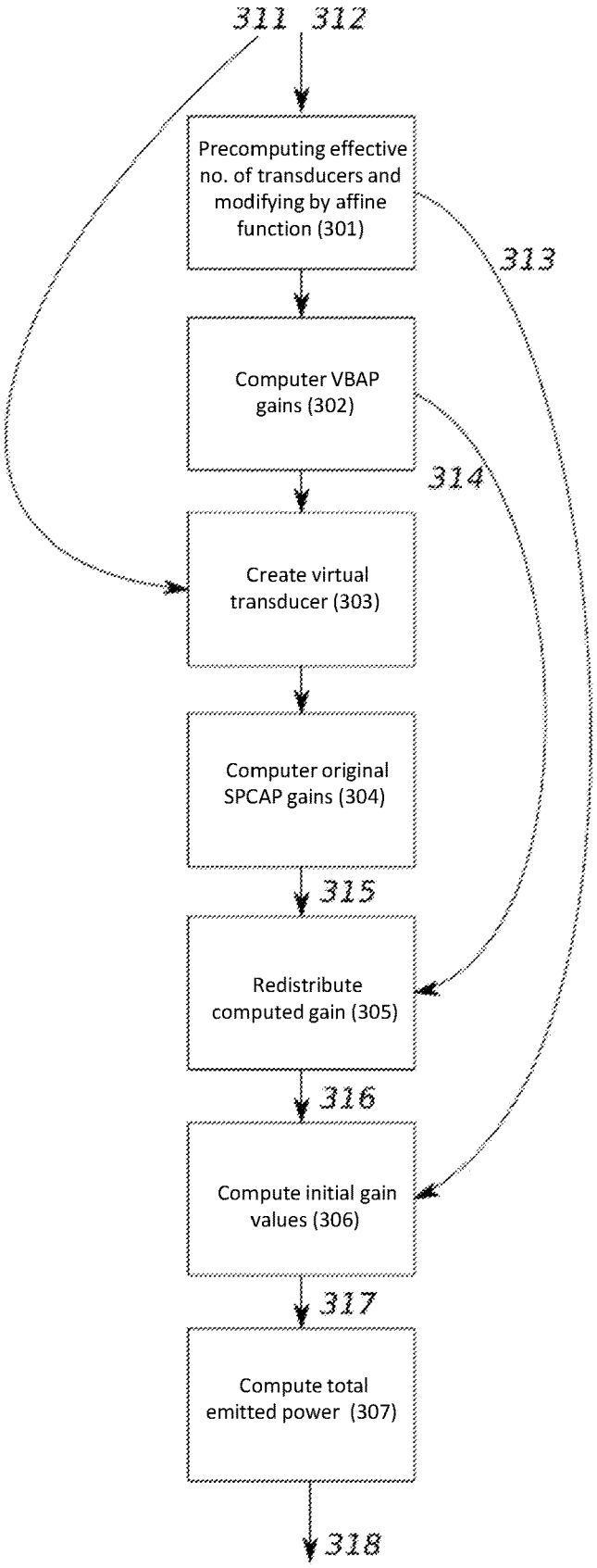
FIG. 3 illustrates a third method example embodiment of the method according to the present invention.

Particularly, FIG. 3 shows the method as implemented in an embodiment of the present invention, ensuring panning of a source over N loudspeakers positioned on a spherical surface, where the spherical coordinates of the source (311) and those of the loudspeakers (312) are known, where are shown the steps of (301) computing the N modified effective number of speakers (313), (302) computing VBAP gains for each facet and determining the facet for which all gains are positive, thereby keeping the three enclosing facet gains (314), (303) adding virtual speaker at the source position (311), (304) computing modified SPCAP gains (315) for N+1 loudspeakers using the method recited in the third step of the second system of claim 3, (305) redistributing the N+1th gain over the enclosing facet using the enclosing loudspeakers gains (313), yielding N gains (316), (306) computing the initial gain values (317), and (307) power normalizing the N gains to yield N final gains (318).

Figure 4:
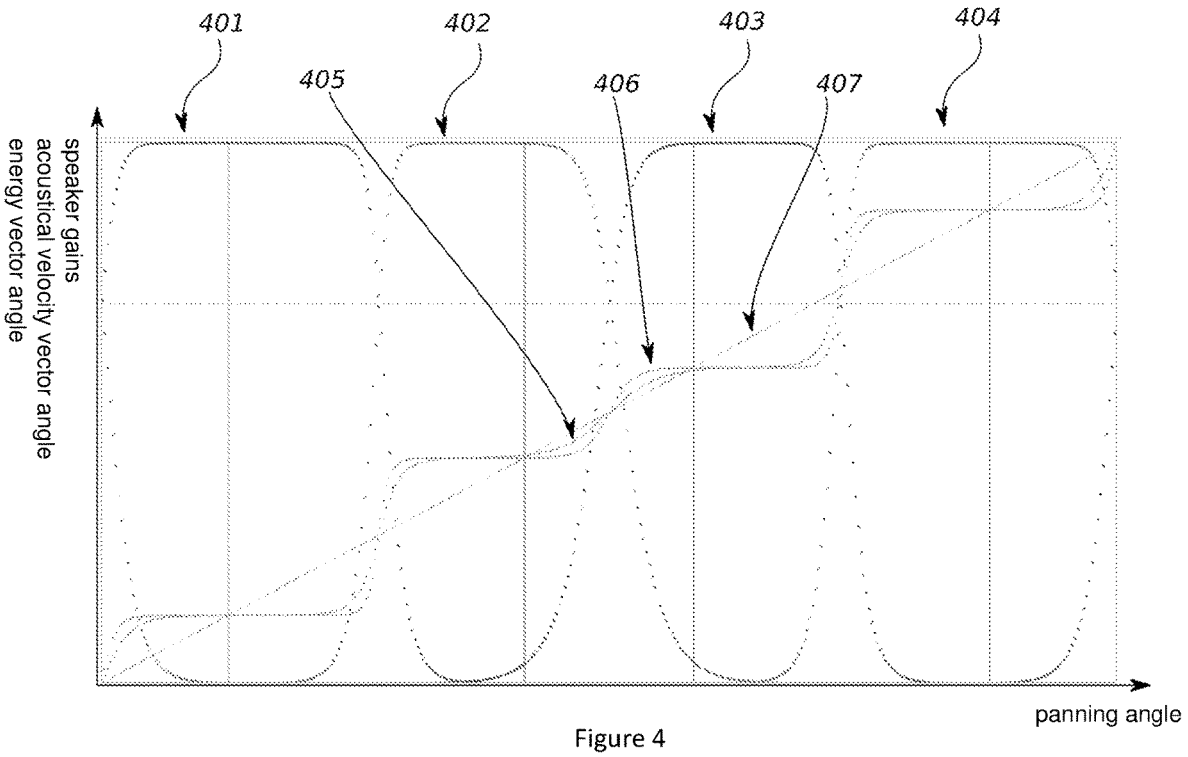
FIG. 4 illustrates the effect of tightness control for the state of the art SPCAP algorithm, with a narrow directivity.

Example 4: Comparison of an Example Embodiment of the Present Invention to State of the Art Methods FIG. 4 illustrates the effect of tightness control for the state of the art SPCAP algorithm, with a narrow directivity. Particularly, FIG. 4 shows, in the context of the original SPCAP algorithm, the speakers gains (401, 402, 403, 404) and the angles of the acoustical velocity (405) and energy (406) vectors compared to the sought panning angle (407), for a typical, irregular four-speaker layout (±30°, ±110°), with a value of the spread-related width d=0.75 for the variable tightness control (where d ranges between 0 and 1). As can be seen, such a narrow tightness causes a speaker attraction effect with energy and velocity vectors jumping between angles.

Figure 5:
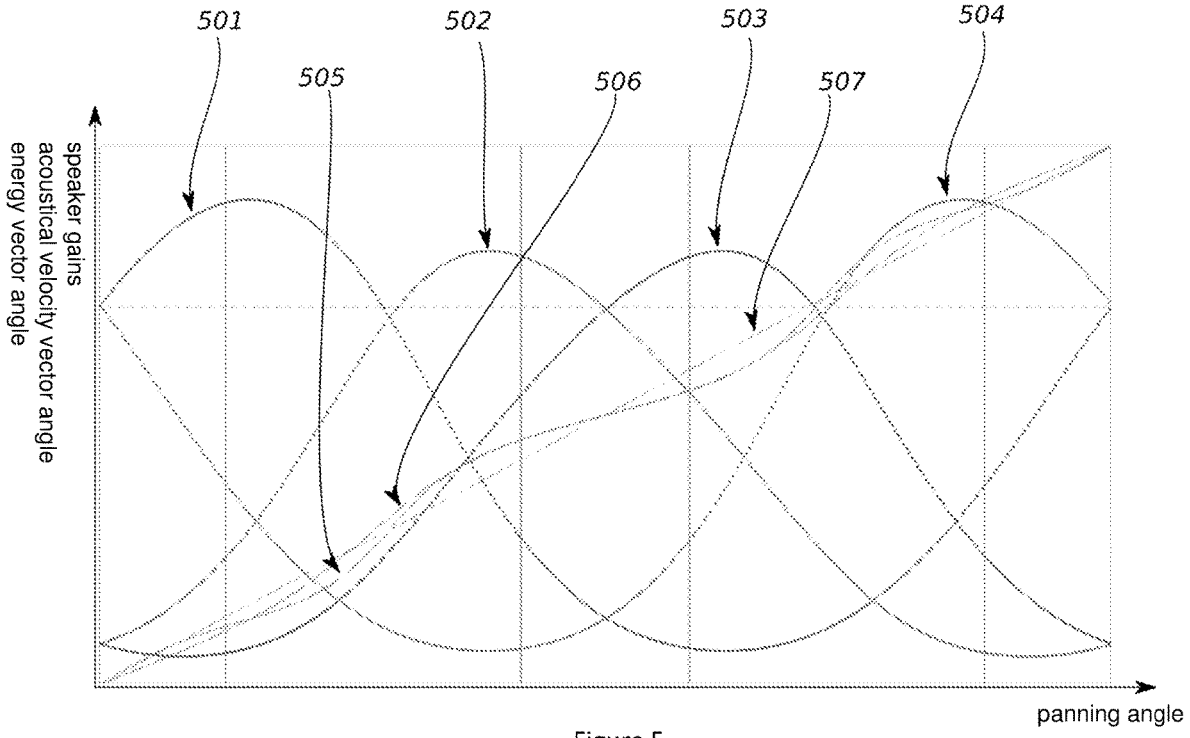
FIG. 5 illustrates the effect of tightness control for the state of the art SPCAP algorithm, with a wide directivity.

FIG. 5 illustrates the effect of tightness control for the state of the art SPCAP algorithm, with a wide directivity. Particularly, FIG. 5 shows, in the context of the original SPCAP algorithm, the speakers gains (501, 502, 503, 504) and the angles of the acoustical velocity (505) and energy (506) vectors compared to the sought panning angle (507), for a typical, irregular four-speaker layout (±30°, ±110°), with a value of the spread-related width d=0.50 for the variable tightness control (where d ranges between 0 and 1). As can be seen, such a wide tightness causes signal spilling among loudspeakers.

Figure 6:
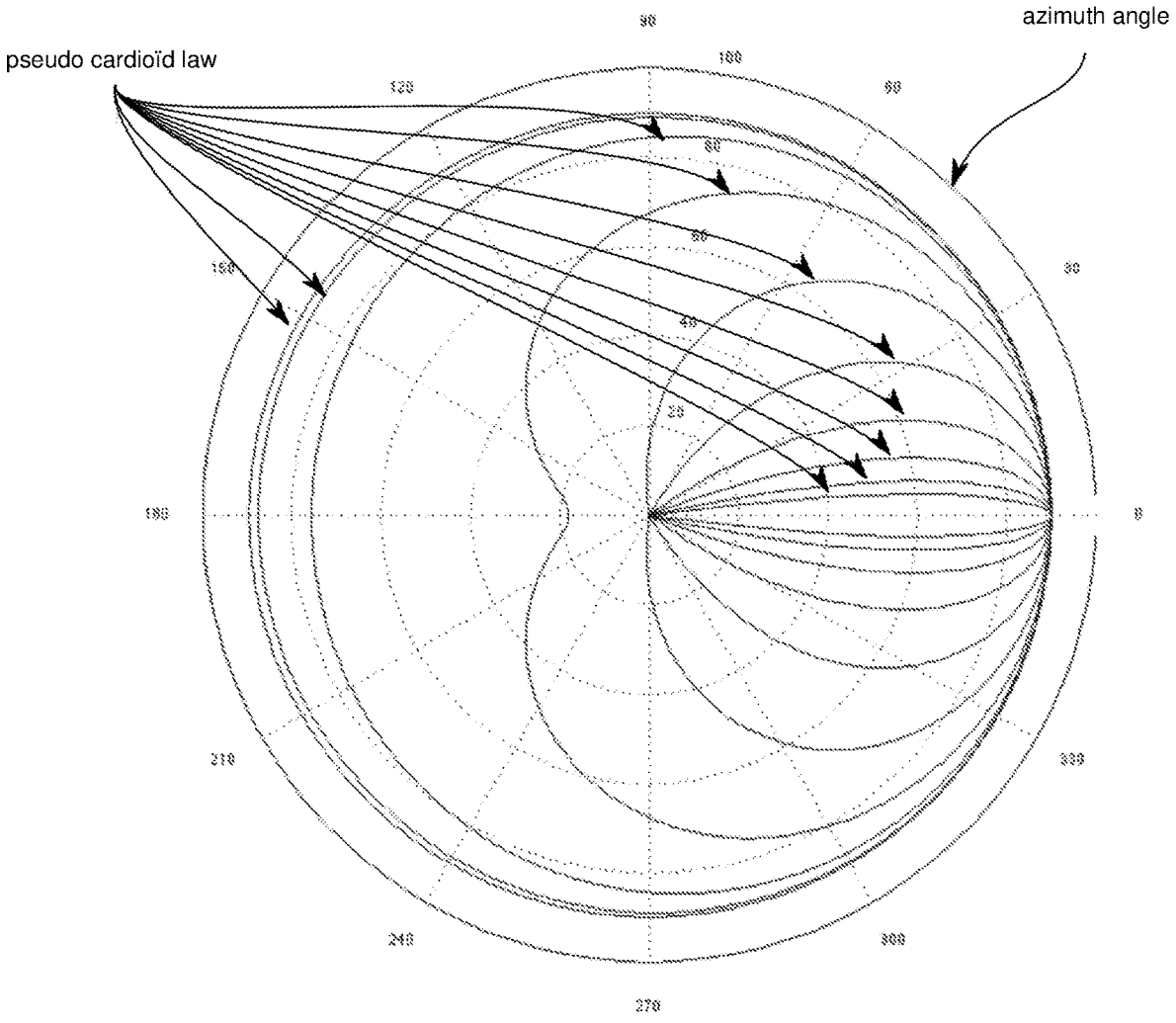
FIG. 6 illustrates the behavior of an example modified pseudo-cardioid law according to the present invention.

FIG. 6 illustrates the behavior of an example modified pseudo-cardioid law according to the present invention. Particularly, FIG. 6 presents the behavior of the modified pseudo-cardioid law (602) along the azimuth angle (601) varying from 0 to 360°, as implemented in some embodiments of the present invention.

Figure 7:
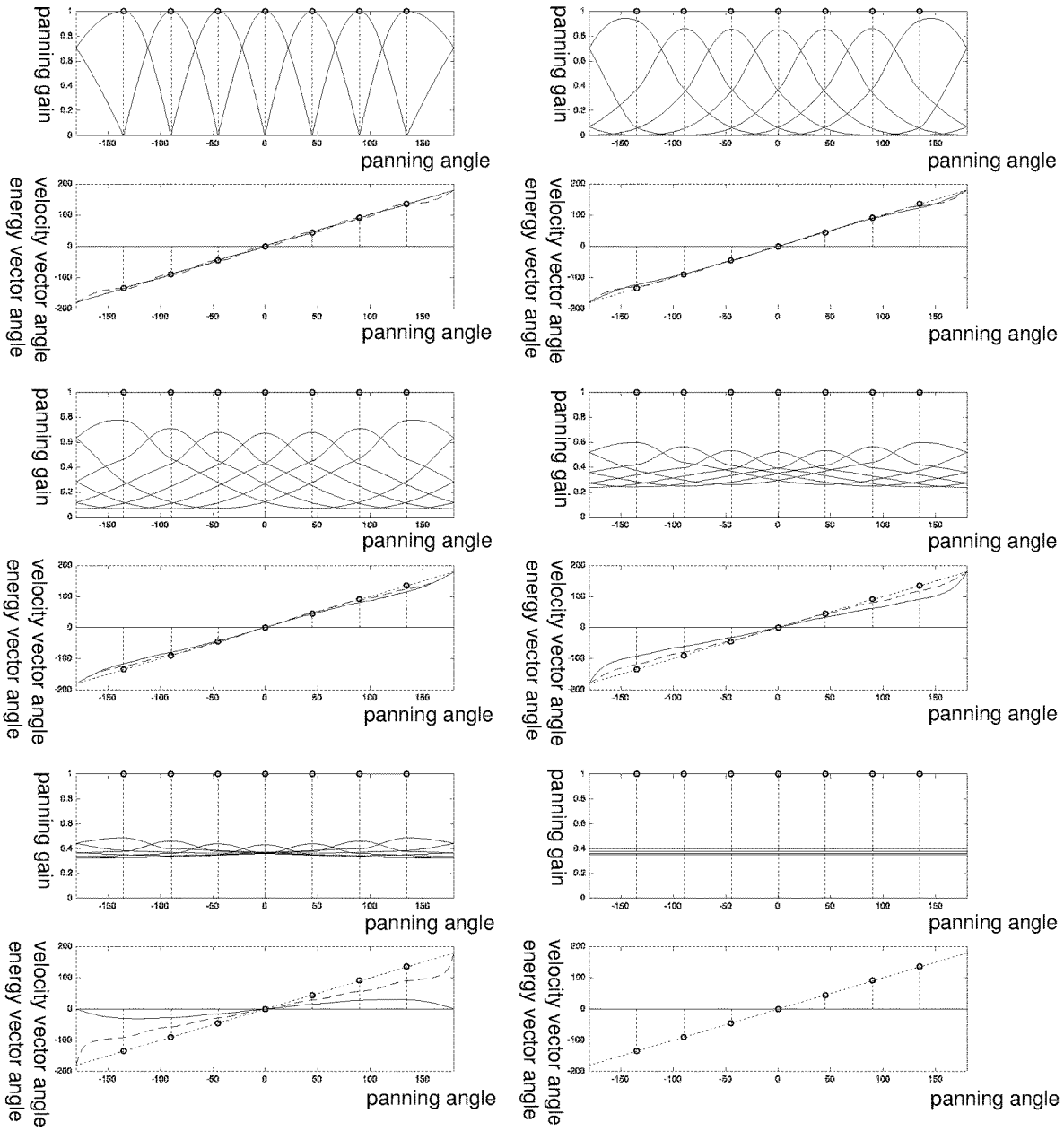
FIG. 7 illustrates a range of results for an example embodiment of the present invention.

FIG. 7 illustrates a range of results for an example embodiment of the present invention. Particularly, FIG. 7 shows the result of panning a source on a set of seven speakers (N=7) positioned at respective azimuths 0°, ±45°, ±900 and ±135°, using the principles of the present invention. Hereby, it is assumed that the loudspeakers are positioned on the inner surface of an essentially spherical volume, whereby each of them is positioned on a single horizontal line section defined on the surface of the sphere. Results using spread-related width values d equal to 1.0, 0.8, 0.6, 0.4, 0.2 and 0.0 are shown respectively from left to right and from top to bottom. Hereby, the spread-related width d is used instead of the spread u merely for ease of comparison with prior art methods; the corresponding spread value u is obtained through u=d/(1−d). For each spread value, the top chart shows the panning gains for all speakers, as well as the speakers positions (circled), and the bottom chart shows the theoretical panning angle (dotted line) as well as velocity (solid line) and energy (dashed line) vectors angles. It can be seen that for focused sources the standard VBAP panning gains can be retrieved closely, and that the positional precision degrades gracefully when the source spread increases.

Example 5: An Example Embodiment Relating to Object-Based Audio Rendering for Monitoring and Playback This example provides an example embodiment of the present invention, related to rendering of object-based audio. Rendering of Object-based Audio and other features such as head tracking for binaural audio, require the use of a high-quality panning/rendering algorithm.

In this example, LSPCAP is used to perform these tasks.

High-Level Features

LSPCAP is a lightweight, scalable panning algorithm, available in two versions that target any 2D/3D speaker arrangement:

irregular room-centric layouts, such as Auro-3D, with snap and zone-control regular listener-centric layouts, especially those suited to Ambisonics decoding LSPCAP also allows for a separated horizontal/vertical control over audio object focus/spread. LSPCAP ensures a better directional precision (energy and amplitude vectors) than pair-wise, VBAP or HOA panning, even for wide (spread) audio objects.

Underlying Technologies

LSPCAP works by coupling a modified Speaker Placement Correction Amplitude Panning (SPCAP) algorithm with a generalized Vector-Based Amplitude Panning (VBAP) along with specific energy vector maximization.

Usages of the Enhanced LSPCAP Algorithm

Two modes of the algorithm were developed: a full-3D listener-centric and a layered 3D room-centric mode.

Listener-Centric Mode

This version accepts spherical or polar coordinates for objects, and uses a spherical speaker arrangement, which advantageously should be as regular as possible. The following arrangements are implemented:

TABLE 1

1. Speaker arrangements in listener-centric mode of LSPCAP

| Arrangement | # speakers | HOA Order Achievable | HOA Order Equivalent | Note |
|---|---|---|---|---|
| Octahedron | 6 | 1 | 1+ | The tetrahedron, with 4 vertices (speakers) wasn't implemented as it is too sparse to give good sonic results |
| Cube | 8 | 1 | 2 | |
| Icosahedron | 12 | 2 | 3 | |
| Dodecahedron | 20 | 3 | 4 | |
| Lebedev Grids | 26 | 4 | 6 | Lebedev rules are triangle-based, maximally regular quadratures of the sphere |
| | 41 | 5 | 8 | |
| | 50 | 6 | 10 | |
| | 74 | 7 | 12 | |

For each arrangement, the achievable HOA order, should an HOA renderer be used with this arrangement, is shown. Next to it, the equivalent HOA order achieved by LSPCAP is shown, which merges the following metrics over the whole sphere and frequency range: ITD precision, ILD precision.

The precision of the directional rendering rises with the number of speakers; of course, the computational complexity rises as well, and this is especially important when using LSPCAP for binaural rendering.

This version will mostly be used as an intermediate rendering between panning of objects and binaural rendering (e.g. Auro-Headphones), as spherical, regular speaker layouts are unpractical in most real-world situations. Its precision is better, ITD- and ILD-wise, than that of the achievable HOA rendering for a given layout.

Room-Centric Mode

The room-centric mode accepts Cartesian coordinates, and is especially targeted for panning of objects to real speaker setups in a room.

Internally, it is built with a number of layers of planar (2D) version of SPCAP.

Each layer accepts only an azimuth angle for the objects, and describes the speakers with their azimuth angles as well. These azimuth angles are derived from the X-Y coordinates of the objects and speakers.

The Z coordinates are used to pan between successive layers. The Top layer has a special behavior: a dual SPCAP-2D algorithm is run on the X-Z and Y-Z planes (the top layer speakers are then projected on those two planes), and the results are merged to form the top layer gains.

Parameters

Listener-Centric Version

Speaker Layout Setup

TABLE 2

LSPCAP Listener-centric mode: Speaker Setup

| Parameter | Type | Range Min | Range Max | Usage |
|---|---|---|---|---|
| Speaker Density | uint(3) | 1 | 8 | Controls the spatial density of the speaker arrangement and the number N of speakers. |
| Speaker Weights | float array (n) continuous | 0.0 f | 1.0 f | Array of float values between 0 and 1. Controls the weight of each speaker within the n-speakers layout. |

The listener-centric loudspeaker setup can be defined by means of a discrete speaker density parameter, ranging from 1 to 8, which controls the regular spherical arrangement as well as the amount of speakers in the layout (see also elsewhere in this document).

Source Parameters

TABLE 3

LSPCAP Listener-centric mode: Source Parameters

| Parameter | Type | Range Min | Range Max | Usage |
|---|---|---|---|---|
| Azimuth (az) | | −TT | TT | Controls the object azimuth |
| Elevation (el) | | −TT/2 | TT/2 | Controls the object elevation |
| Spread | | 0 | 1 | Object spatial spread. The higher the value, the more focused the object |

Room-Centric Mode

Speaker Layout Setup

The room-centric LSPCAP algorithm only supports speakers positioned on walls of a virtual room. Therefore, for each speaker, at least one of the X, Y, Z parameters must have an absolute value of 1.01.

TABLE 4

4. LSPCAP Room-centric mode: Speaker Setup

| Parameter | Type | Range Min | Range Max | Usage |
|---|---|---|---|---|
| Speaker.X | | −1.0 f | 1.0 f | Position on the X-axis (left-right). +1.0 f puts the speaker on the right hand-side wall. |
| Speaker.Y | | −1.0 f | 1.0 f | Position on the Y-axis (front-back). +1.0 f puts the speaker on the front wall. |
| Speaker.Z | | −1.0 f | 1.0 f | Position on the Z-axis (top-bottom). +1.0 f puts the speaker on the ceiling, whereas −1.0 f puts speakers on the floor, below ear level (e.g. for NHK 22.2). 0.0 f is considered to be the standard Surround level, at ear-height. All values in-between create separate speaker layers. |
| Zone | | | | Describes the Zone to which the speaker belongs (see elsewhere in this document). |
| Spatial Power Equalization | bool | false | true | Controls whether SPE will be enabled for the layout. SPE allows compensating for irregularities in the spatial distribution of speakers in the layout, by aligning the energy vector with the target source position. |

Source Parameters

TABLE 5

LSPCAP Room-centric mode: Source Parameters

| Parameter | Type | Range Min | Range Max | Usage |
|---|---|---|---|---|
| Object.X | | −1.0 f | 1.0 f | Position on the X-axis (left-right). +1.0 f puts the object on the right hand-side wall. |
| Object.Y | | −1.0 f | 1.0 f | Position on the Y-axis (front-back). +1.0 f puts the object on the front wall. |
| Object.Z | | −1.0 f | 1.0 f | Position on the Z-axis (top-bottom). +1.0 f puts the speaker on the ceiling, whereas −1.0 f puts speakers on the floor, below ear level (e.g. for NHK 22.2). 0.0 f is considered to be the standard Surround level, at ear-height. All values in-between create separate speaker layers. |
| Width | | 0.0 f | 1.0 f | Object horizontal spatial spread. The higher the value, the more focused the object. |
| Height | | 0.0 f | 1.0 f | Object vertical spatial spread. The higher the value, the more focused the object. |
| Snap | bool | false | true | Snaps the source to the nearest speaker in the actual speaker layout. |
| Zone Control | | | | Enables zone control for the source. Can be combined with speaker snap. |

The Zone Control parameter allows controlling which speakers (or speaker zones) will be used by the panned source. The exact meaning of the parameter depends on the actual speaker layout. In the following table the active speakers are given for a 7.1 planar layout, the same principle applies to other layouts, including Auro-3D layouts. New zones can be implemented as needed in the SDK. This may relate to the TpFL/TpFR being at azimuth angle of +45/−45.

2D Version Algorithm

Usage:

panning on speakers positioned on room's walls (front back left right top walls)

Inputs:

object coordinates, Cartesian object horizontal spread value u (range 0 to +infinity)

object vertical spread value v (range 0 to +infinity)

speaker arrangement:

Cartesian coordinates for each speaker, are normalized (left-right and front-back dimensions range from −1 to 1, as for bottom-top Z=0 for ear-level, Z=1 for ceiling)

Algorithm:

Offline Part:

transform all speaker coordinates (X, Y, Z) to cylindrical coordinates (azimuth, Z)

determination of horizontal layers: speakers that bear the same Z coordinate belong to the same layer Real-Time Part:

(A) transform object coordinates to cylindrical coordinates (azimuth, Z) by using azimuth=a tan 2(X,Y)

if no azimuth can be computed (original object coordinates were 0,0) then assign an arbitrary azimuth and set object spread value to 0 (maximum spread)

(B) project the object on each layer along the Z axis (i.e. remove the Z coordinate).

(C) for each layer save the top/ceiling one:

(1) find the two enclosing speakers α and β by using object and layer's speakers azimuths:

(2) compute the two enclosing speakers gains $Q_\alpha$ and $Q_\beta$ using any stereo panning law (for ex. "tangent" panning law, or "sin-cos panning law" or any other law).

(3) virtually create a new loudspeaker in the layer, positioned at the object position. The layer now comprises N+1 speakers (N physical speakers and one virtual speaker)

(4) compute the SPCAP gains for the N speakers in the current layer, using the modified LSPCAP method:

(a) compute the N+1 (N real speakers, 1 virtual) original gains using the following law $$P_i(\theta_{is}) = \frac{1}{\left(2+\frac{1}{u}\right)^u}\left(1+\frac{1}{u}+\cos(\theta_{is})\right)^2,\ u \in [0, \infty],\ i \in [1 \ldots N+1]$$

where $\theta_{is}$ is the angle between the source and the speaker (b) compute the so-called "effective number of speakers" $\beta_i$ for only the N real loudspeakers $$\beta_i = \frac{1}{\left(2+\frac{1}{u}\right)^u}\left(1+\frac{1}{u}+\cos(\theta_i-\theta_j)\right)^u,\ u \in [0, \infty],\ i \in [1 \ldots N]$$

That value allows taking the speaker spatial density into account, by putting less weight (ie. less gain) on speakers that are close to each other. The number is computed for each speaker, using the whole set of speakers (including the one considered in the computation). One can note that $\beta_i$ is at least equal to 1. This value can be further modified by an affine function between 1 and its original value, to gradually account (or not) for the speaker density, if needed.

(c) redistribute the computed gain for the virtual (N+1)-th speaker by using the stereo gains $Q_\alpha$ and $Q_\beta$ computed above in step (2)

$$P_i = \sqrt{P_i^2 + \sqrt{\frac{u}{1+u}} \cdot Q_i^2}, \text{ where } i = \alpha \text{ or } i = \beta$$

(d) compute the "initial gain values" $G_1$ by dividing the original gains by the effective number of speakers $$G_i(\theta_s) = \frac{P_i(\theta_{is})}{\beta_i}, i \in [1 \ldots N]$$

(e) ensure power conservation by computing the total emitted power $$P_e(\theta) = \sum_{i=1}^{N} (G_i(\theta))^2$$

and by dividing the initial gains to yield the corrected gains for each speaker:

$$A_i = \frac{G_i}{\sqrt{P_e}}, i \in [1 \ldots N]$$

(D) for the top (Z=1) layer:

(1) project the M top-layer speaker coordinates onto the X axis (only keep the $X_i$ where i∈[1 . . . M] coordinates)

(2) project the source coordinate, onto the X axis (only keep the $X_s$)

(3) saturate source coordinate so that it's in the same range as the M speakers X coordinates $$X_2 = \max(X_3, \min(X_i))$$

$$X_3 = \min(X_3, \max(X_i))$$

(4) construct an array of M angles $$\theta_i = \frac{X_i - \min(X_i)}{\max(X_i) - \min(X_i)} \cdot \pi, i \in [1 \ldots M]$$

(5) construct the angle of the source $$\theta_s = \frac{X_s - \min(X_i)}{\max(X_i) - \min(X_i)} \cdot \pi, i \in [1 \ldots M]$$

(6) compute the M SPCAP gains Amusing the method in (C4)

(7) redo steps D1 to D6 but use the Y axis instead of the X axis, yielding M SPCAP gains $A_{iy}$ (8) compute joint top-layer gain: $A_i = A_{ix}, A_{iy}$ (9) compute total emitted power $P_s = \Sigma_{i=1}^{M} (A_i)^2$

(10) divide joint top-layer gains by total power to get the normalized top-layer gains $$A_i' = \frac{A_i}{\sqrt{P_e}}, i \in [1 \ldots M]$$

(E) compute layer gains for each layer in the K layers, by treating each layer as one speaker, and using the following steps: (similar to what we do in the top layer, followed by the SPCAP algorithm from (C))

(1) construct an array of angles $$\theta_i = \frac{Z_i - \min(Z_i)}{\max(Z_i) - \min(Z_i)} \cdot \pi, i \in [1 \ldots K]$$

(2) construct the angle of the source $$\theta_s = \frac{Z_s - \min(Z_i)}{\max(Z_i) - \min(Z_i)} \cdot \pi, i \in [1 \ldots K]$$

(3) find the enclosing layers α and β by using object and layer's angles from steps (E1) and (E2)

(4) compute the two enclosing layers gains $Q_\alpha$ and $Q_\beta$ using any stereo panning law (for ex. "tangent" panning law, or "sin-cos panning law" or any other law).

(5) virtually create a new loudspeaker positioned at the object angle from E2

(6) apply the steps from C4a to C4e, using the K+1 angles from (E1) and (E2), replacing the horizontal spread u by the vertical spread v, which yields K layer gains (7) for each layer, multiply the speaker gains from (C) by the layer gains from (E6)

Further aspects and potential extensions relate to zone control and speaker groups definition.

3D Version

Usage:

panning on speakers positioned on a sphere

Inputs:

object coordinates, spherical object spread value u (range 0 to +infinity)

speaker arrangement:

Spherical coordinates for each speaker spherical triangular mesh where speakers are positioned at the vertices.

Algorithm:

(A): compute VBAP gains for each facet in the mesh and find enclosing facet for which all speaker gains are positive. Keep only the three gains for that facet, discard the rest (see Pulkki, 2001 for the detailed VBAP method)

(B): virtually create a new loudspeaker in the speaker arrangement, positioned at the object position. The arrangement now comprises N+1 speakers (N physical speakers and one virtual speaker)

(C) compute the SPCAP gains for the N speakers using the modified LSPCAP method:

(1) compute the N+1 (N real speakers, 1 virtual) original gains using the following law $$P_i(\theta_{is}) = \frac{1}{\left(2+\frac{1}{u}\right)^u}\left(1+\frac{1}{u}+\cos(\theta_{is})\right)^2, u \in [0, \infty], i \in [1 \ldots N+1]$$

where $\theta_{is}$ is the angle between the source and the speaker (2) compute the so-called "effective number of speakers" $\beta_i$ for only the N real loudspeakers $$\beta_i = \frac{1}{\left(2+\frac{1}{u}\right)^u}\left(1+\frac{1}{u}+\cos(\theta_i-\theta_j)\right)^u, u \in [0, \infty], i \in [1 \ldots N]$$

That value allows taking the speaker spatial density into account, by putting less weight (ie. less gain) on speakers that are close to each other. The number is computed for each speaker, using the whole set of speakers (including the one considered in the computation). One can note that $\beta_i$ is at least equal to 1. This value can be further modified by an affine function between 1 and its original value, to gradually account (or not) for the speaker density, if needed.

(3) redistribute the computed gain for the virtual (N+1)-th speaker by using the three VBAP gains Q computed above in step (A)

$$P_i = \sqrt{P_i^2 + \sqrt{\frac{u}{1+u}} \cdot Q_i^2},$$

i such that speaker i belongs to the active VBAP facet (4) compute the "initial gain values" $G_i$ by dividing the original gains by the effective number of speakers $$G_i(\theta_s) = \frac{P_i(\theta_{is})}{\beta_i}, i \in [1 \ldots N]$$

(5) ensure power conservation by computing the total emitted power $$P_e(\theta) = \sum_{i=1}^{N} (G_i(\theta))^2$$

and by dividing the initial gains to yield the corrected gains for each speaker:

$$A_i = \frac{G_i}{\sqrt{P_e}}, i \in [1 \ldots N]$$

The invention claimed is:

1. A method of processing an audio object along an axis, said audio object (151) comprising an audio object abscissa and an audio object spread, for spatialized restitution thereof over a plurality of sound transducers, N in number, aligned along said axis; each of said sound transducers comprising a transducer abscissa (152); N being at least equal to two; said method comprising the steps of:

executing a first process (110) comprising a mapping of the transducer abscissa (152) of each of said plurality of sound transducers and of the audio object abscissa (151) on a circle quadrant, yielding N transducer angles (154) for said plurality of transducers and one audio object angle (153), $\theta_s$, for said audio object;

executing a third process (130) comprising the substeps of:

(132) computing an effective number of transducers (159), $\beta_i$ for each transducer i of the plurality of transducers via $$\beta_i = \sum_{j=1}^{N} \frac{1}{(2)^u}(1+\cos(\theta_i-\theta_j))^u u \in [0, \infty], i \in [1 \ldots N],$$

wherein $\theta_i$ is the transducer angle for the transducer i, $\theta_j$ is the transducer angle for the transducer j, and u denotes spread and (133) computing a transducer gain $P_i$ (160) for each of said plurality of transducers, i∈[1 . . . N], via $$P_i(\theta_{is}) = \frac{1}{(2)^u}(1+\cos(\theta_{is}))^u, u \in [0, \infty], i \in [1 \ldots N],$$

where $\theta_{is}$ is the angle between the audio object and the transducer i; and executing a fourth process (140) comprising the substeps of:

(142) computing an initial gain value $G_i$ (163) for each of said plurality of transducers, N in number, by dividing said transducer gain (162) by said effective number of transducers (159)

$$G_i(\theta_s) = \frac{P_i(\theta_{is})}{\beta_i}, i \in [1 \ldots N],$$

and (143) ensuring power conservation by computing a total emitted power, $P_e$, via $P_e(\theta_s)=\Sigma_{i=1}^{N}(G_i(\theta_s))^2$ and computing, for each of said plurality of transducers, N in number, a corrected gain (164), $A_i$, via $$A_i = \frac{G_i}{\sqrt{P_e}}, i \in [1 \ldots N];$$

wherein:

said method further comprises executing a second process (120) comprising the substeps of:

(122) identifying, from the plurality of transducers, a first transducer α (155) and a second transducer β (156) that are closest to the audio object, and (123) computing gains $Q_\alpha$ (157) and $Q_\beta$ (158) according to a stereo panning law over said first transducer α (155) and said second transducer β (156);

said third process (130) further comprises:

an additional substep of (131) creating a virtual transducer comprising a virtual transducer angle equal to said audio object angle (153) and adding said virtual transducer angle to a list of transducers angles (154), N in number, thereby creating an expanded list of transducer angles, N+1 in number; and a gain substep (133) of computing said transducer gain, said gain substep (133) further comprising computing a virtual transducer gain $P_{N+1}$ (161) corresponding to said virtual transducer angle, via:

$$P_i(\theta_{is}) = \frac{1}{(2)^u}(1+\cos(\theta_{is}))^u,\ u \in [0, \infty],\ i = N+1,$$

$$P_i(\theta_{is}) = \frac{1}{(2)^u}(1+\cos(\theta_{is}))^u,\ u \in [0, \infty],\ i \in [1 \ldots N+1],$$

where $\theta_{N+1,s}$ is the angle between the audio object and the virtual transducer; and said fourth process (140) further comprises:

an additional substep of (141) redistributing said virtual transducer gain $P_{N+1}$ (161) over said first transducer α (155) and said second transducer β (156) by using said gains $Q_\alpha$ (157) and $Q_\beta$ (158) computed in the second process (120), yielding a modified gain $P'_\alpha$ (162) for said first transducer α (155) and a modified gain $P'_\beta$ (162) for said second transducer β (156) according to $$P'_i = \sqrt{P_i^2 + \sqrt{\frac{u}{1+u}} \cdot Q_i^2},$$

where i=α or i=β;

wherein said computing of said initial gain value $G_i$ (163) is done with said modified gain $P'_\alpha$ (162) instead of said gain $P_\alpha$ for said first transducer α (155) and said modified gain $P'_\beta$ (162) instead of said gain $P_\beta$ for said second transducer β (156).

2. Method according to claim 1, wherein said stereo panning law is any or any combination of the following: tangent panning law, sin-cos panning law.

3. A method of processing an audio object, for spatialized restitution thereof over a plurality of sound transducers, N in number, positioned on an inner surface of a parallelepipedic room comprising a ceiling, a front wall and a lateral wall; N being at least equal to two, said sound transducers positioned according to an XYZ orthonormal frame comprising an X axis, a Y axis and a Z axis, whereby said Z axis extends toward and is orthogonal to said ceiling, the Y axis extends toward and is orthogonal to said front wall and the X axis extends toward and is orthogonal to said lateral wall, wherein each of said transducers and said audio object comprise Cartesian coordinates (200) with respect to said XYZ orthonormal frame for an abscissa; wherein said audio object comprises a spread value with respect to said XYZ orthonormal frame, wherein said method comprises the steps:

in a first step (201), obtaining a Z-gain (207) for each of said plurality of transducers, using only the Z abscissae of said plurality of transducers and the Z spread value, in a second step (202), determining a unique Z coordinates list for a transducer arrangement, effectively constructing Z-layers, in a third step (203), obtaining Y-gains (208) for each of said plurality of transducers and for each of said Z-layers, using only said Z-layer's transducers' Y abscissae and the Y spread value, in a fourth step (204), determining, for each said Z-layer, unique Y coordinates list, effectively constructing Y rows, in a fifth step (205), obtaining X-gains (209) for each of said plurality of transducers, for each Z layer and for each Y row, using only the rows' transducers' X abscissae and the X spread value, and in a sixth step (206), multiplying said X-gains (209), Y-gains (208) and Z-gains (207) element-wise, and applying 2-norm normalization to obtain final transducer gains (210) for the whole transducer arrangement, wherein:

said determining of said Z-gain (207) in the first step (201) is performed with the method according to claim 1 along the Z-axis, said determining of said Y-gain (207) in the third step (203) is performed with the method according to claim 1 along the Y-axis, and said determining of said X-gain (207) in the fifth step (205) is performed with the method according to claim 1 along the X-axis.

4. A method of processing an audio object, for spatialized restitution thereof over a plurality of transducers, N in number, positioned on an inner surface of a sphere, N being at least equal to two; said audio object comprising an audio object position and an audio object spread; said method comprising the steps of:

executing a first process (301) comprising the substeps of:

(pre)computing the effective number of transducers $\beta_i$ based on the plurality of transducers, where i represents the number of transducers, the audio object position and the audio object spread, and modifying $\beta_i$ by an affine function between 1 and the original value of $\beta_i$, yielding modified effective number of transducers (313); and executing a second process, for given object coordinates, comprising a first step (302) that computes Vector-Based Amplitude Panning (VBAP) gains for each facet in the mesh and finds enclosing facet for which each of the transducer gains $Q_i$ are positive, and discards the other gains, yielding three VBAP gains (314), a second step (303) that creates a virtual transducer in the transducer arrangement, positioned at the object position (311), so that the modified arrangement comprises N+1 transducers, a third step (304) that computes original Speaker Placement Correction Amplitude Panning (SPCAP gains) (315) for the N+1 transducers, a fourth step (305) that redistributes the computed gain for the virtual (N+1)-th transducer by using the three VBAP gains $Q_i$ (312) computed above in the above first step (302) and the original SPCAP gains (315), yielding N modified SPCAP gains (316), a fifth step (306) that computes the initial gain values $G_i$ (317) by dividing the original SPCAP gains (316) by the modified effective number of transducers (313) as precomputed by the first system above $$G_i(\theta_s) = \frac{P_i(\theta_{is})}{\beta_i},\ i \in [1 \ldots N],$$

wherein $\theta_i$ is the transducer angle for the transducer i, where $\theta_{is}$ is the angle between the audio object and the transducer i, and a sixth step (307) that ensures power conservation by computing the total emitted power, $P_e$, via $P_e(\theta_s)=\Sigma_{i=1}^{N}(G_i(\theta_s))^2$ and by dividing the initial gains values (317) to yield the corrected gains (318), $A_i$, for each transducer:

$$A_i = \frac{G_i}{\sqrt{P_e}},\ i \in [1\ \ldots\ N],$$

wherein:

the computation of said effective number of transducers (313) uses the following formula:

$$\beta_i = \sum_{j=1}^{N} \frac{1}{\left(2+\frac{1}{u}\right)^u}\left(1+\frac{1}{u}+\cos(\theta_i-\theta_j)\right)^u,\ u \in [0, \infty],\ i \in [1\ \ldots\ N]$$

$$\beta_i = \frac{1}{\left(2+\frac{1}{u}\right)^u}\left(1+\frac{1}{u}+\cos(\theta_i-\theta_j)\right)^u,\ u \in [0, \infty],\ i \in [1\ \ldots\ N];$$

the third step (304) of the second process uses the following formula:

$$P_i(\theta_{is}) = \frac{1}{\left(2+\frac{1}{u}\right)^u}\left(1+\frac{1}{u}+\cos(\theta_{is})\right)^u,\ u \in [0, \infty],\ i \in [1\ \ldots\ N+1]$$

wherein $\theta_{is}$ is the angle between the source and the transducer and u denotes spread; and the fourth step (305) of the second process uses the following formula:

$$P_i = \sqrt{P_i^2 + \sqrt{\frac{u}{1+u}} \cdot Q_i^2},$$

i such that speaker i belongs to the active VBAP facet.

* * * * *